United States Patent [19]

Berger

[11] 4,324,853

[45] Apr. 13, 1982

[54] PHOTOGRAPHIC PROCESSING COMPOSITION CONTAINING POLYOL

[75] Inventor: Michael Berger, Chestnut Hill, Mass.

[73] Assignee: Polaroid Corporation, Cambridge, Mass.

[21] Appl. No.: 58,683

[22] Filed: Jul. 18, 1979

[51] Int. Cl.[3] ..... G03C 5/54; G03C 5/38; G03C 5/30; G03C 7/00

[52] U.S. Cl. ..... 430/245; 430/233; 430/244; 430/247; 430/248; 430/249; 430/251; 430/419; 430/429; 430/456; 430/488; 430/490; 430/491

[58] Field of Search ..... 430/233, 248, 244, 419, 430/429, 456, 488, 490, 491, 251, 249, 247, 245

[56] References Cited

U.S. PATENT DOCUMENTS

| | | | |
|---|---|---|---|
| 2,415,666 | 2/1947 | Weissberger et al. | 430/490 |
| 2,662,822 | 12/1953 | Land | 430/233 |
| 3,220,838 | 11/1965 | Humphlett et al. | 430/251 |
| 3,615,426 | 10/1971 | Debruyn | 96/29 R |
| 3,615,427 | 10/1971 | Debruyn | 96/29 R |
| 3,615,428 | 10/1971 | Weed | 96/29 R |
| 3,615,429 | 10/1971 | Weed | 96/29 R |
| 3,615,440 | 10/1971 | Bloom et al. | 96/29 R |
| 3,658,527 | 4/1972 | Kunz et al. | 430/249 |
| 3,684,512 | 8/1972 | Cain et al. | 430/488 |
| 3,894,871 | 7/1975 | Land | 96/76 R |
| 4,126,459 | 11/1978 | Greenwald | 430/251 |

*Primary Examiner*—Richard L. Schilling
*Attorney, Agent, or Firm*—Philip G. Kiely

[57] ABSTRACT

A processing composition adapted for use in a silver diffusion transfer process which includes a saturated polyol containing at least 3 hydroxyl groups wherein each hydroxyl group is no more than 3 carbon atoms away from another hydroxyl group.

19 Claims, No Drawings

PHOTOGRAPHIC PROCESSING COMPOSITION CONTAINING POLYOL

BACKGROUND OF THE INVENTION

Procedures for preparing photographic images in silver by diffusion transfer principles are well known in the art. For the formation of the positive silver image, a latent image contained in an exposed photosensitive silver halide emulsion is developed and almost concurrently therewith, a soluble silver complex is obtained by reaction of a silver halide solvent with the unexposed and undeveloped silver halide of said emulsion. The photosensitive silver halide emulsion is developed with a processing composition which may be spread between the photosensitive element comprising the silver halide emulsion and a second element which may comprise a suitable silver-precipitating layer. The processing composition effects development of the latent image in the emulsion and, substantially contemporaneously therewith, forms a soluble silver complex, for example, a thiosulfate or thiocyanate, with undeveloped silver halide. This soluble silver complex is, at least in part, transported in the direction of the print-receiving layer and the silver thereof is largely precipitated in the silver precipitating element to form a positive image thereon. Procedures of this description are disclosed, for example, in U.S. Pat. No. 2,543,181 issued to Edwin H. Land. See, also, Edwin H. Land, *One Step Photography,* Photographic Journal, Section A, pp. 7–15, January 1950.

Additive color reproduction may be produced by exposing a photosensitive silver halide emulsion through an additive color screen having filter media or screen elements each of an individual additive color, such as red or green or blue, and by viewing the reversed or positive silver image formed by transfer to a transparent print-receiving element through the same or a similar screen which is suitably registered with the reversed positive image carried by the print-receiving layer.

As examples of suitable film structures for employment in additive color photography, mention may be made of U.S. Pat. Nos. 2,861,885; 2,726,154; 2,944,894; 3,536,488; 3,615,427; 3,615,428; 3,615,429; 3,615,426; and 3,894,871.

Many film assemblies disclosed in the above-indicated patents find particular utility in cine film systems such as, for example the system described in U.S. Pat. No. 3,615,127 which includes a compact film cassette or container adapted to allow exposure of a film assemblage retained therein, subsequent processing of the film unit to provide the desired image record and projection of the resultant image record. Thus, the film assemblage may be exposed, processed, dried if necessary, and projected without transferring the film from its original container. The cine film system of U.S. Pat. No. 3,615,127 includes a film processing station whereupon the exposed film strip is transported from a first storage reel, past an applicator where a moist processing composition adapted to develop to a visible condition images recorded on the film is applied and thence to a second storage reel.

Copending application Ser. No. 649,201, filed Jan. 14, 1976, abandoned and replaced by U.S. application Ser. No. 69,282 filed Aug. 24, 1979 (commonly assigned) discloses and claims a receiving element particularly suited for use in an additive color photographic diffusion transfer film unit which comprises a transparent support carrying an additive color screen and a layer comprising noble metal silver-precipitating nuclei and a polymer; wherein the nuclei are present in a level of about 0.1–0.3 mgs/ft$^2$, and said polymer is present at a level of from about 0.5 to 5 times the coverage of said nuclei. Preferably, the noble metal is obtained by reduction of a noble metal salt or complex, and more preferably, the noble metal is palladium.

Copending applications Ser. No. 897,943 and 897,942, both filed Apr. 4, 1978, and commonly assigned disclose and claim image-receiving elements particularly suited for use in additive diffusion transfer film units of the type described which comprise noble metal silver precipitating nuclei and, respectively, gelatin and hydroxyethyl cellulose and gelatin and polyvinyl alcohol at specified levels and ratios of the polymers.

The additive diffusion transfer film units disclosed above are processed by an aqueous alkaline processing composition which includes a silver halide developing agent and a silver halide solvent.

Silver halide solvents useful in forming the desired soluble complex with unexposed silver are well known and, for example, may be selected from the alkali metal thiosulfates, particularly sodium or potassium thiosulfates, or the silver halide solvent may be a cyclic imide, such as uracil, in combination with a nitrogenous base as taught in U.S. Pat. No. 2,857,273 issued Oct. 21, 1975, to Edwin H. Land or a pseudo uracil, such as the 4,6-dihydroxyprimidines as taught in U.S. Pat. No. 4,126,459, issued Nov. 21, 1978.

The processing composition may contain a thickening agent, such as an alkali metal carboxymethyl cellulose or hydroxyethyl cellulose, in a quantity and viscosity grade adapted to facilitate application of the processing composition. The processing composition may be left on the processed film or removed, in accordance with known techniques, as is most appropriate for the particular film use. The requisite alkalinity, e.g., a pH of 12–14, is preferably imparted to the processing composition by an alkaline material such as sodium, potassium and/or lithium hydroxide.

Suitable silver halide developing agents may be selected from amongst those known in the art, and may be initially positioned in a layer of the photosensitive element and/or in the processing composition. Organic silver halide developing agents are generally used, e.g., organic compounds of the benzene or naphthalene series containing hydroxyl and/or amino groups in the para-or ortho-positions with respect to each other, such as hydroquinone, tert-butyl hydroquinone, toluhydroquinone, p-aminophenol, 2,6-dimethyl-4-aminophenol, 2,4,6-triaminophenol, etc. If the additive color transparency is one which is not washed after processing to remove unused silver halide developing agent, development reaction products, etc., the silver halide developing agent, development reaction products, etc., should not give rise to colored reaction products which might stain the image or which, either unreacted or reacted, might adversely affect the stability and sensitometric properties of the final image. Particularly useful silver halide developing agents having good stability in alkaline solution are substituted reductic acids, particularly tetramethyl reductic acid, as disclosed in U.S. Pat. No. 3,615,440 issued Oct. 26, 1971 to Stanley M. Bloom and Richard D. Cramer.

The above-mentioned additive diffusion transfer film units, particularly when employed as an elongated strip in a motion picture mode, often are processed in a manner which does not provide for washing or otherwise removing or neutralizing the processing composition in the layers of the film unit. In some instances, with time the projected image exhibited dark areas of various shapes and disposition which has been attributed to crystal formation or a salting out of one or more of the processing composition reagents or processing by products in the film unit. While not intending to be bound by theory, it is believed that the crystals are derived from developer and/or silver halide solvent. These crystals are generally found at or adjacent to the surface of the film unit. Copending Application Ser. No. 897,940, filed Apr. 4, 1978 (commonly assigned), now U.S. Pat. No. 4,168,166, is directed to the employment of a borate in the processing composition which substantially obviates the above-mentioned crystal problem.

Another defect has been observed which is also believed to involve crystal formation but this time the crystals are located within the film unit structure rather than being associated with the surface and appear as white spots in the projected image after the film has been processed and stored for some time. It is believed that the crystal growth destroys the integrity of the positive image layer; in effect making a "hole" in the positive image layer. While the invention of copending application Ser. No. 897,940 is effective with the surface associated defect, it does not appear to be effective against the interior crystal formation.

SUMMARY OF THE INVENTION

The present invention is directed to a novel photographic processing composition for use in processing a silver diffusion transfer film unit wherein said processing composition includes an aqueous alkaline solution, a silver halide developing agent, a silver halide solvent and a saturated polyol containing at least three hydroxyl groups wherein each hydroxyl group is no more than 3 carbon atoms away from another hydroxyl group. In a preferred embodiment, the processing composition also includes an alkali soluble borate compound.

DETAILED DESCRIPTION OF THE INVENTION

By means of the present invention the above-mentioned interior crystal formation which results in the white spots in the projected image, are virtually eliminated by employing, in the processing composition, a saturated polyol containing at least 3 hydroxyl groups wherein each hydroxyl group is no more than 3 carbon atoms away from another hydroxyl group.

As examples of suitable polyols mention may be made of the following:

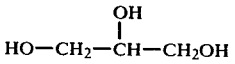

Glycerol

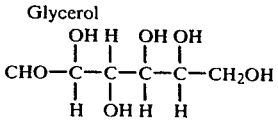

Glucose

-continued

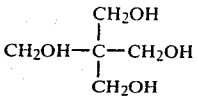

Pentaerythritol

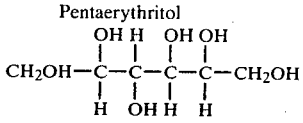

Sorbitol

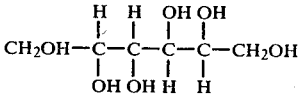

D-Mannitol

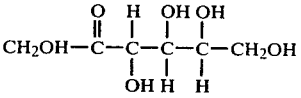

Fructose

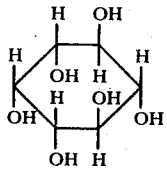

Inositol

The polyols employed in the present invention are saturated compounds, contain only carbon, hydrogen and oxygen, and contain at least 3 hydroxyl groups wherein no hydroxyl group is further than 3 carbons away from another hydroxyl group.

Thus, related compounds, such as ethylene glycol, 1,2-propanediol and 1,3-propanediol are not effective in preventing or alleviating the crystal formation. Similarly, triethanol amine, which contains 3 hydroxyl groups is also not effective.

The quantity of polyol most effective for a given processing composition and film unit can be readily determined by a routine scoping series. The lower limit is determined by the degree of effectiveness desired. Excessive amounts of polyols may have a detrimental effect on sensitometry of the film unit, and thus, this factor must be considered in determining the upper limits. Preferably, the polyol within the scope of the present invention is employed at a level of 0.1 g to 1 g per 10 cc of processing composition. Within this range, sensitometry is not appreciably affected. In amounts in excess of 1 g per 10 cc, however, a loss of $D_{max}$ has been observed. In a particularly preferred embodiment, about 0.2 g per 10 cc of processing composition is employed.

It is also preferred that the above-indicated polyol be employed in the processing composition with a borate as defined in copending application Ser. No. 897,940; i.e. a borate which is soluble in aqueous alkaline solution and which is present at a level of about 0.25 to 15 mmol per 10 cc of processing composition.

As stated above, the novel processing composition of the present invention is particularly useful in additive diffusion transfer film units and in film units where the processing composition is not removed from the film unit.

The following non-limiting examples illustrate the use of the novel processing composition of the present invention.

EXAMPLE A

A film unit was prepared comprising a transparent polyester film base carrying on one surface, an additive color screen of approximately 1500 triplets per inch of red, blue and green filter screen elements in repetitive side-by-side relationship; 328 mgs/ft$^2$ polyvinylidine chloride/polyvinyl formal protective overcoat layer; a nucleating layer comprising palladium nuclei at a coverage of 0.15 mgs/ft$^2$ Pd, 0.15 mgs/ft$^2$ gelatin and 0.8 mgs/ft$^2$ hydroxyethyl cellulose; an interlayer formed by coating 1.9 mgs/ft$^2$ gelatin, 2.3 mgs/ft$^2$ acetic acid and 0.19 mgs/ft$^2$ octylphenoxy polyethoxy ethanol surfactant; a hardened gelatino silver iodobromo emulsion (a 50—50 blend of 0.59$\mu$ and 0.72$\mu$ mean diameter grains) coated at a coverage of about 69.4 mgs/ft$^2$ of gelatin and about 84 mgs/ft$^2$ of silver with about 3.25 mgs/ft$^2$ of propylene glycol alginate and about 0.55 mgs/ft$^2$ of nonyl phenol polyglycol ether (containing 9.5 moles of ethylene oxide); and 18.9 mgs/ft$^2$ of a carboxylated styrene/butadiene copolymer latex (Dow 620, Dow Chemical Company, Midland, Mich.) panchromatically sensitized with 5,5'-dimethyl-9-ethyl-3,3'-bis-(3-sulfopropyl) thiacarbocyaninetriethyl-ammonium salt (0.53 mg/g Ag); 5,5'-diphenyl-9-ethyl-3,3'-bis-(4-sulfobutyl-)oxacarbocyanine (0.75 mg/g Ag); anhydro 5,6-dichloro-1,3-diethyl-3'-(4''-sulfobutyl)-benzimidazolo-thiacarbocyanine hydroxide (0.75 mg/g Ag); and 3-(3-sulfopropyl)-3'-ethyl-4,5-benzothia-thiacyanine betaine (1.0 mg/g Ag); red, green, green and blue sensitizers respectively; and the following antihalo top coat. The antihalo top coat referred to below is disclosed and claimed in copending application Ser. No. 383,261, filed July 27, 1973.

| Top Coat | mgs/ft$^2$ |
|---|---|
| Gelatin | 400 |
| Dow 620 (carboxylated styrene/butadiene copolymer latex Dow Chemical Co., Midland, Michigan) | 204 |
| Propylene glycol alginate | 25.7 |
| Dioctyl ester of sodium sulfosuccinate | 1.2 |
| Daxad-11 (polymerized sodium salts of alkyl naphthalene sulfonic acid) Manufactured by W. R. Grace & Co. Cambridge, MA | 0.38 |
| Pyridinium bis-1,5 (1,3-diethyl-2-thiol-5-barbituric acid) pentamethine oxanol (silver complex) | 5.8 |
| 4-(2-chloro-4-dimethylamino benzaldehyde)-1-(p-phenyl carboxylic acid)-3-methyl pyrazolone-5 | 7 |
| Benzimidazole-2-thiol gold ($Au^{+1}$) complex | 5 (as gold) |

| PROCESSING COMPOSITION A | Weight % |
|---|---|
| Sodium hydroxide | 8.62 |
| Hydroxyethyl cellulose (Sold by Hercules, Inc., Wilmington, Delaware under the tradename Natrasol 250 HH) | 0.64 |

-continued

| PROCESSING COMPOSITION A | Weight % |
|---|---|
| Tetramethyl reductic acid | 7.20 |
| Potassium bromide | 0.63 |
| 2-methylthiomethyl-4,6-dihydroxypyrimidine | 7.2 |
| 4-aminopyrazolo-[3,4d]-pyrimidine | 0.02 |
| N-benzyl-α-picolinium bromide (50% solution) | 3.60 |
| Sodium tetraborate . $10H_2O$ | 3.40 |
| Sodium sulfite | 0.83 |
| Water | 67.89 |

The film prepared as above was loaded into a POLAVISION PHOTOTAPE cassette exposed in a POLAVISION camera to a studio scene and processed in a POLAVISION player (Polaroid Corp., Cambridge, Mass.) and then projected four times. The film in the cassette was then stored for 5 days in a warm, moist environment (100° F., 80% R.H.) and then 12–24 hours in a hot, dry environment (120° F., 10% R.H.) and then projected and examined for defects. This storage cycle was repeated 8 times and then the defect levels set forth below in Table I were determined.

The described processing composition was employed with the below indicated polyols added thereto. As indicated above, the crystal formation and positive image layer disruption is manifested as white spots in the projected image.

TABLE 1

| Example | Polyol | g/10cc. | Results |
|---|---|---|---|
| 1 Control | — | — | Many "white spots", objectionable in all scenes. |
| 2 | Glycerol | 0.2 | No "white spots" observed. |
| 3 | Pentaerythritol | 0.2 | No "white spots" observed. |
| 4 | Glucose | 0.2 | No "white spots" observed. |
| 5 | Sorbitol | 0.2 | No "white spots" observed. |
| 6 | D-mannitol | 0.2 | No "white spots" observed |
| 7 | Fructose | 0.2 | No "white spots" observed |
| 8 | Inositol | 0.2 | "White spots" just detectable in high density areas; |
| 9 | Ethylene glycol | 0.2 | Many "white spots", objectionable in all scenes. |
| 10 | 1,2-propanediol | 0.2 | Many "white spots", objectionable in all scenes. |
| 11 | 1,3-propanediol | 0.2 | Many "white spots", objectionable in all scenes. |
| 12 | Triethanolamine | 0.2 | Many "white spots", objectionable in all scenes. |
| 13 | Diethanolamine | 0.2 | Many "white spots", objectionable in all scenes. |

Film units prepared as above were given a 16 mcs exposure with an Xenon sensitometer and processed with mechanical rollers with a 1.2 mil gap disposing the processing composition between the top coat and a polyethylene terephthalate cover sheet by reading the neutral column to red, green and blue light on an automatically recording densitometer on the film units immediately after processing. The results are recorded in Table 2. The control (Example 14) was processed with the following processing composition and Examples 15, 16 and 17 with the indicated amounts of glycerol added.

| PROCESSING COMPOSITION B | Weight % |
|---|---|
| Sodium hydroxide | 8.57 |
| Hydroxyethyl cellulose (Sold by Hercules, Inc., | 0.64 |

-continued

| PROCESSING COMPOSITION B | Weight % |
|---|---|
| Wilmington, Delaware under the tradename Natrasol 250 H H) | |
| Tetramethyl reductic acid | 7.16 |
| Potassium bromide | 0.63 |
| 2-methylthiomethyl-4,6-dihydroxypyrimidine | 7.2 |
| 4-aminopyrazolo-[3,4d]-pyrimidine | 0.02 |
| N-benzyl-α-picolinium bromide (50% solution) | 3.58 |
| Sodium tetraborate . $10H_2O$ | 3.36 |
| Sodium sulfite | 0.83 |
| p-isononylphenoxypolycidol (containing about 10 glycidol units) | 0.50 |
| Water | 67.55 |

TABLE 2

| Example | Glycerol (g/10cc) | $D_{max}$ Red | Green | Blue |
|---|---|---|---|---|
| 14 (Control) | 0 | 3.02 | 3.20 | 3.12 |
| 15 | 0.2 | 3.09 | 3.19 | 3.01 |
| 16 | 0.6 | 3.11 | 3.16 | 3.05 |
| 17 | 2.0 | 2.37 | 2.36 | 2.39 |

From the above table it will be seen that little effect on sensitometry is observed until relatively large amounts of the polyol is employed.

While the present invention is defined primarily in terms of additive color systems, it should be understood that the novel stabilizer compounds of the present invention are also suitable for use in black and white silver diffusion transfer systems.

The support employed in the present invention is not critical. The support or film base employed may comprise any of the various types of transparent rigid or flexible supports, for example, glass, polymeric films of both the synthetic type and those derived from naturally occurring products, etc. Especially suitable materials, however, comprise flexible transparent synthetic polymers such as polymethacrylic acid, methyl and ethyl esters; vinyl chloride polymers; polyvinyl acetals; polyamides such as nylon; polyesters such as the polymeric films derived from ethylene glycol terephthalic acid; polymer cellulose derivatives such as cellulose acetate propionate; polycarbonates; polystyrenes; and the like.

The additive color screen employed in the present invention may be formed by techniques well known in the art, e.g., by sequentially printing the requisite filter patterns by photomechanical methods. An additive color screen comprises an array of sets of colored areas or filter elements, usually from two to four different colors, each of said sets of colored areas being capable of transmitting visible light within a color filter element that transmits light within one of the so-called primary wavelength ranges, i.e., red, green and blue. The additive color screen may be composed of minute dyed particles, such as starch grains or hardened gelatin particles, intermixed and interspersed in a regular or random arrangement to provide a mosaic. A regular mosaic of this type may be made by the alternating embossing and doctoring technique described in U.S. Pat. No. 3,019,124. Another method of forming a suitable color screen comprises multi-line extrusion of the type disclosed in U.S. Pat. No. 3,032,008, the colored lines being deposited side-by-side in a single coating operation. Still another method is set forth in U.S. Pat. No. 3,284,208.

What is claimed is:

1. A photographic processing composition adapted for use with a silver diffusion transfer film unit which comprises an aqueous alkaline solution, a silver halide developing agent, a silver halide solvent and glycerol, wherein said glycerol is present at a level of about 0.1–1.0 g per 10 cc of said processing composition.

2. The composition of claim 1 wherein said glycerol is present at a level of about 0.2 g per 10 cc of said composition.

3. The composition as defined in claim 1 which includes a borate which is soluble in said aqueous alkaline solution.

4. The composition of claim 3 wherein said borate is sodium tetraborate decahydrate.

5. The composition of claim 1 wherein said silver halide developing agent is tetramethyl reductic acid.

6. The composition of claim 1 wherein said silver halide solvent is 2-methylthiomethyl-4,6-dihydroxypyrimidine.

7. The composition as defined in claim 1 which includes a polymeric thickening agent.

8. The composition of claim 1 wherein said film unit is an additive color diffusion transfer film unit.

9. A photographic processing composition adapted for use with an additive color diffusion transfer film unit which comprises an aqueous sodium hydroxide solution, tetramethyl reductic acid, 2-methylthiomethyl-4,6-dihydroxypyrimidine, hydroxyethyl cellulose, glycerol and sodium tetraborate decahydrate.

10. The method which comprises contacting an exposed silver diffusion transfer film unit which comprises a support carrying on one surface, a layer comprising silver precipitating nuclei, and a silver halide layer; with a photographic processing composition adapted for use with a silver diffusion transfer film unit which comprises an aqueous alkaline solution, a silver halide developing agent, a silver halide solvent and glycerol, wherein said glycerol is present at a level of about 0.1–1.0 g per 10 cc of said processing composition.

11. The method of claim 10 wherein said glycerol is present at a level of about 0.2 g per 10 cc of said processing composition.

12. The method of claim 10 which includes the step of drying said film unit without removing said processing composition.

13. The method of claim 10 wherein said film unit includes an additive color screen.

14. The method of claim 10 wherein said silver precipitating nuclei are noble metal nuclei.

15. The method of claim 12 wherein said noble metal nuclei are palladium nuclei.

16. The method of claim 10 wherein said processing composition includes a borate which is soluble in said aqueous alkaline solution and which is present at a level of about 0.25 to 15 mmol per 10 cc of processing composition.

17. The method of claim 9 wherein said processing composition includes a polymeric thickener.

18. The method of claim 15 wherein said polymeric thickener is hydroxyethyl cellulose.

19. The method which comprises contacting an exposed additive color diffusion transfer film unit which comprises a transparent support carrying, in order, an additive color screen; a layer comprising palladium metal silver precipitating nuclei and gelatin; a photosensitive silver halide emulsion layer; and an anti-halation layer; with a processing composition comprising an aquous sodium hydroxide solution, hydroxyethyl cellulose, tetramethyl reductic acid, 2-methylthiomethyl-4,6-dihydroxypyrimidine, sodium tetraborate decahydrate and glycerol.

* * * * *